US006296224B1

(12) United States Patent
Hayakawa

(10) Patent No.: US 6,296,224 B1
(45) Date of Patent: Oct. 2, 2001

(54) CONCRETE FORM MEMBER

(76) Inventor: Yoshiyuki Hayakawa, 5-22, Miyanomori 2-jo 12-chome, Chuo-ku, Sapporo-shi, Hokkaido (JP)

( * ) Notice: Subject to any disclaimer, the term of this patent is extended or adjusted under 35 U.S.C. 154(b) by 0 days.

(21) Appl. No.: 09/260,002

(22) Filed: Mar. 2, 1999

(30) Foreign Application Priority Data

Mar. 16, 1998 (JP) ..... 10-065246

(51) Int. Cl.[7] ..... E04G 11/08

(52) U.S. Cl. ..... 249/47; 249/43; 249/192; 52/630

(58) Field of Search ..... 52/424, 425, 426, 52/562, 177, 630; 249/33, 40, 42, 43, 44, 47, 189, 190, 192, 213, 216

(56) References Cited

U.S. PATENT DOCUMENTS

| | | | | |
|---|---|---|---|---|
| 5,632,923 | * | 5/1997 | Hayakawa | 249/47 |
| 5,761,874 | | 6/1998 | Hayakawa . | |
| 5,836,126 | * | 11/1998 | Harkenrider | 52/410 |

FOREIGN PATENT DOCUMENTS

| | | |
|---|---|---|
| 637 297 | 12/1963 | (BE) . |
| 294 607 | 2/1954 | (CH) . |
| 2 012 032 | 9/1971 | (DE) . |
| 37 03 935 A1 | 6/1988 | (DE) . |
| 196 22 149 A1 | 12/1997 | (DE) . |
| 0 448 120 A1 | 9/1991 | (EP) . |
| 0 738 808 | 10/1996 | (EP) . |
| 1 219 287 | 5/1960 | (FR) . |
| 62-54149 | 4/1987 | (JP) . |

* cited by examiner

*Primary Examiner*—Michael Safavi
(74) *Attorney, Agent, or Firm*—McDermott, Will & Emery

(57) ABSTRACT

A form member comprises a strip-shaped main plate portion, which is flat at least on its front surface, a horizontal pair of strip-shaped side plate portions extending from both sides of the main plate portion toward its rear surface perpendicularly to the main plate portion, and a reinforcing plate provided to extend from the rear surface of the main plate portion substantially in parallel with the horizontal pair of side plate portions. Each of the side plate portions and the reinforcing plate includes an enlarged end portion over a prescribed width from its opening end. An end plate body having an engaging portion of a shape for tightly engaging with an end of the form member body engages with this end, to form a single form member. A concrete form member reduced in thickness and weight and enabled to suppress inconvenient deformation in concrete placing can be provided due to this structure.

7 Claims, 17 Drawing Sheets

CONCRETE FORM MEMBER

BACKGROUND OF THE INVENTION

1. Field of the Invention

The present invention relates to a concrete form member for assembling a concrete form employed for placing concrete or forming a concrete secondary product in construction work or engineering works, for example.

2. Description of the Prior Art

In general, a wooden form member prepared by nailing cross bars to a plywood board or a metal form member prepared by fixing metal ribs to an iron plate or an aluminum plate is known as this type of concrete form member. As a typical example of the conventional wooden form member, FIG. 11A shows a form member 70 prepared by fixing a flat plate 71 of plywood, for example, to a plurality of reinforcing cross bars 72 with nails 73. In order to assemble a concrete form with such form members 70, nails 73 are driven into adjacent reinforcing cross bars 72 of the form members 70 for connecting and fixing the same to each other. FIG. 11B shows an exemplary concrete form having a cross-shaped concrete forming part 74 assembled in the aforementioned manner. The flat plate 71 may be formed by a plastic plate, in place of the plywood board.

An example of a conventional form member space holder for fixing a pair of form members 70 at a prescribed space through concrete placing surfaces when assembling a concrete form with the form members 70 is described with reference to FIGS. 12 and 13A to 13C. Referring to FIG. 12, the conventional form member space holder is mainly formed by a separator 121, attachments 122 and clamp members 123. The separator 121 is formed by a bar provided with a pair of male screws 121*a* on both ends thereof, as shown in FIG. 13A. Each male screw 121*a* is fitted with a female screw 122*c* provided on an end of each attachment 122 shown in FIG. 13B. The attachment 122 is provided on another end with a male screw 122*d*, which is substantially coaxial with the female screw 122*c*, passing through a separator mounting hole 76 provided in each form member 70 so that an end of a substantially truncated-conical presser 122*a* of resin engaging with the outer periphery of an attachment body part 122*b* is in contact with the concrete placing surface of the form member 70. A female screw 123*a* provided on an end of each clamp member 123 is fitted with the male screw 122*d* of the attachment 122, thereby clamping/fixing the attachment 122 to the form member 70.

A male screw 123*b* is provided on another end of the clamp member 123, so that a support member 124 and a nut 125, mounted on this male screw 123*b* fix thin cylindrical form support members 126 of a metal to bridge a plurality of transversely arranged form members 70.

As a typical example of the conventional metal form member, FIG. 14A shows a form member 80 prepared by bonding/fixing side plates 82 and reinforcing plates 83 to a metal flat plate 81. FIG. 14B shows an exemplary concrete form having a cross-shaped concrete forming part 84 assembled by a plurality of such metal form members 80. In this form, metal auxiliary members 85 are employed on corners of the cross-shaped concrete forming part 84, in addition to the form members 80.

Japanese Utility Model Laying-Open No. 62-54149 (1987) discloses a conventional form member of synthetic resin. In the form member of synthetic resin described in this literature, reinforcing projections are integrally provided on four points on the rear surface of a plate member of plastic having a square front surface. These projections have receiving holes for connectors, while receiving holes for separators are formed in prescribed portions of the plate member.

Among the aforementioned conventional form members, the wooden form member is lightweight and has a degree of freedom in execution. However, the wooden form member has such disadvantages that the same can be reused only three or four times since the plywood board absorbing strong alkaline moisture starts to come off from an end portion when used several times, requires skill for assembling/execution, is unsuitable for global environmental protection due to consumption of Laura as raw material and industrial wastes resulting after use, and is not applicable to high-grade concrete having a low slump and high strength due to limitation of employment of a vibrator resulting from low strength.

Further, the hygroscopius plywood board absorbs moisture from a surface of placed concrete, which is in contact with the plywood board, and an ideal water-cement ratio of the concrete is lost in this portion, to result in rough finishing of the outer surface of the concrete. In this case, the concrete may be erroneously regarded as defectively hardened. Therefore, prescribed coating is applied to the surface of the plywood board for reducing its hygroscopius. However, the cost for such a coated plywood board is unpreferably increased.

Although the metal form member has high strength, the degree of freedom in working is so small that the executable range is limited and the form member is hardly applicable to general construction work. Further, the heavy metal form member must inevitably be reduced in size, leading to inferior execution efficiency. Further, the metal form member is generally rusted or unusably deformed if insufficiently managed, and extremely hard to repair in such a state.

In order to solve the aforementioned problems of the conventional concrete form members, the inventor has already proposed the structure of a concrete form member shown in FIGS. 15 to 17 in U.S. Pat. No. 5,632,923.

As shown in FIGS. 15 and 16, an improved concrete form member 1 proposed in the aforementioned literature has a main plate portion 3 formed by such a long flat plate that the length between both longitudinal ends 3B (showing in FIG. 17, is set about 10 times that between both cross-directional ends 3A, with flat front and rear surfaces 3C and 3D. A pair of side plate portions 4 are formed by long strip-shaped bodies perpendicularly extending from the cross-sectional ends 3A of the main plate portion 3 toward the rear surface 3D to face each other, and surfaces 4A thereof are flatly formed. Further, a pair of rear plate portions 5 are formed by long strip-shaped bodies perpendicularly extending inward from both cross-directional forward ends 4B of the side plate portions 4 to face the rear surface 3D of the main plate portion 3. Surfaces 5A of the rear plate portions 5 are flatly formed while forward ends thereof inwardly project to form reinforcing thick portions 5B.

A plurality of mounting holes 6 are formed along the cross-directional center of the main plate portion 3 of the form member at prescribed intervals in the longitudinal direction. Further, a plurality of mounting holes 7 are formed in each of the pair of side plate portions 4 in correspondence to the positions of the mounting holes 6 of the main plate portion 3. Each mounting hole 7 is arranged on a position at a prescribed distance L from the front surface 3C of the main plate portion 3 along the cross direction. In addition, a plurality of mounting holes 8 are formed in each of the pair of rear plate portions 5 in correspondence to the positions of the mounting holes 6 of the main plate portion 3. Each mounting hole 8 is formed on a position at a distance L, identical to the distance L between the center of each mounting hole 7 and the front surface 3C of the main plate portion 3, from the surface 4A of each side plate portion 4 along the cross direction.

As shown in FIGS. 17 and 18, each of end plate bodies 9 engaging with both longitudinal ends of a form member body 2 is formed by a flat horizontal end plate portion 10 shielding each longitudinal end of the form member body 2 and a pair of vertical end plate portions 11 and 12 perpendicularly extending from front and rear ends of the horizontal end plate portion 10, and has a substantially U-shaped section. The horizontal end plate portion 10 is formed to engage with a space, having a rectangular plane shape, enclosed with the main plate portion 3, the pair of side plate portions 4 and the pair of rear plate portions 5. In the pair of vertical end plate portions 11 and 12, the front end surface of the front vertical end plate portion 11 is in contact with and fixed to the rear surface 3D of the main plate portion 3, while the rear vertical end plate portion 12 is formed to face the vertical end plate portion 11 and engage with the pair of rear plate portions 5. All surfaces 10A, 11A and 12A of the horizontal end plate portion 10 and the pair of vertical end plate portions 11 and 12 are flatly formed.

The horizontal end plate portion 10 is provided on its longitudinal center with a mounting hole 13, which is arranged on a portion at a distance, substantially identical to the distance L, between the center of each mounting hole 7 and the surface 3C of the main plate portion 3, from the surface 3C of the main plate portion 3 along the cross direction of the horizontal end plate portion 10, as shown in FIG. 18. Further, a mounting hole 14 is formed on the longitudinal center of the rear vertical end plate portion 12, and the center of this mounting hole 14 is arranged on a portion at a distance, substantially identical to the distance L, from the surface 10A of the horizontal end plate portion 10 along the cross direction of the vertical end plate portion 12.

In such an improved conventional concrete form member, each of the form member bodies 2 and the end plate bodies 9 can be prepared by integral forming of fiber-reinforced plastic to implement a relatively lightweight form member having high strength while improving workability in assembling, thereby solving the aforementioned problems of the prior art.

In the structure of the aforementioned improved conventional concrete form member, however, the main plate portion 3 of the form member body 2 is readily concavely deflected and. deformed to open the pair of side plate portions 4 due to pressure applied by concrete in concrete placing. When assembling a form, therefore, a reinforcing member must be brought into contact with the form member for clamping the same in order to ensure flatness of a surface of the formed concrete.

SUMMARY OF THE INVENTION

An object of the present invention is to provide a concrete form member further reduced in thickness and weight as compared with the aforementioned improved conventional concrete form member, which can suppress inconvenient deformation in concrete placing.

In order to attain the aforementioned object, the inventive concrete form member comprises a strip-shaped main plate portion, which is flat at least on its front surface, a horizontal pair of strip-shaped side plate portions extending from both sides of the main plate portion toward its rear surface perpendicularly to the main plate portion, and a reinforcing plate provided to extend from the rear surface of the main plate portion substantially in parallel with the horizontal pair of side plate portions. Each of the pair of side plate portions includes a side plate enlarged end portion inwardly enlarged in thickness over a prescribed width from its opening end, and the reinforcing plate includes a reinforcing plate enlarged end portion enlarged in thickness over a prescribed width from its opening end at least toward one of the side plate portions.

According to the concrete form member having such a structure, the reinforcing plate is provided between the pair of side plate portions and the enlarged portions are provided on the opening ends of the side plate portions and the reinforcing plate. Therefore, the form member is improved in rigidity against bending deformation in a plane parallel to the central longitudinal section of the main plate portion due to the reinforcing effect of the reinforcing plate serving as a rib, and can be inhibited from bending resulting from such bending deformation.

In a preferred embodiment of the present invention, the reinforcing plate enlarged end portion has a shape enlarged in thickness toward both sides of the pair of side plate portions, thereby further reinforcing the rib effect of the reinforcing plate.

More preferably, each of base end surfaces of the side plate enlarged end portion and the reinforcing plate enlarged end portion is provided with a groove concaved toward the opening end and extending along the longitudinal direction of the main plate portion.

The main plate portion, the pair of side plate portions and the reinforcing plate are preferably made of integrally formed fiber-reinforced plastic. By employing this material, a thin and lightweight concrete form member can be manufactured with excellent productivity for providing a concrete form member excellent in operability in assembling of a form and in production cost.

The present invention includes a concrete form member having a form member body formed by a main plate portion, a pair of side plate portions and a reinforcing plate and further comprising a shielding plate portion arranged on at least one of both longitudinal ends of the form member body to shield a longitudinal end of a space, having a rectangular cross section, enclosed with the main plate portion and the pair of side plate portions, and an engaging portion extending from the shielding plate portion by a prescribed length substantially perpendicularly to the shielding plate portion and provided to engage with an end of the form member body by coming into contact with a rear surface of the main plate portion, inner side surfaces of the pair of side plate portions and a surface of the reinforcing plate.

Thus, the end plate body engages with the end of the form member body, thereby reinforcing the rigidity against bending deformation around the pair of side plate portions of the form member body and the longitudinal ends of the reinforcing plate. Consequently, the overall form member is improved in flexural rigidity, the main plate portion is inhibited from bending deformation caused by pressure of placed concrete, and a surface of formed concrete is improved in flatness.

The concrete form member having the aforementioned structure preferably includes a longitudinal projection provided to engage with a groove provided on each of the side plate enlarged end portions and the reinforcing plate enlarged end portion in a part of the engaging portion of the end plate body coming into contact with parts close to the opening ends of the pair of side plate portions and a part close to the opening end of the reinforcing plate.

When the form member body and the end plate body having such shapes are combined with each other so that the engaging portion of the end plate body engages with the end of the form member body, opening of the side plate portions and deformation of the reinforcing plate are suppressed due to the effect of the engagement between the grooves of the form member body and the longitudinal projection of the end plate body, thereby further suppressing bending deformation of the main plate portion in a plane parallel to the cross section of the form member body. Thus, the main plate portion is inhibited from bending caused by pressure in concrete placing, and the surface of the formed concrete is further improved in flatness.

In the concrete form member according to the present invention, the engaging portion of the end plate body preferably includes a plurality of tubular bodies having outer peripheral surfaces coming into contact with the rear surface of the main plate portion, the inner side surfaces of the pair of side plate portions and the surface of the reinforcing plate. According to this structure, the tubular bodies of the end plate body come into contact with the inner surface of the form member body in the vicinity of the end of the form member body, thereby attaining an effect of reinforcing the end of the form member body.

The end plate body is also preferably made of integrally formed fiber-reinforced plastic. Thus, it is possible to provide a lightweight concrete form member having high strength, which can be efficiently produced by plastic forming suitable for mass production.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to FIGS. 1 to 10B.

(Embodiment 1)

Figure 1A:
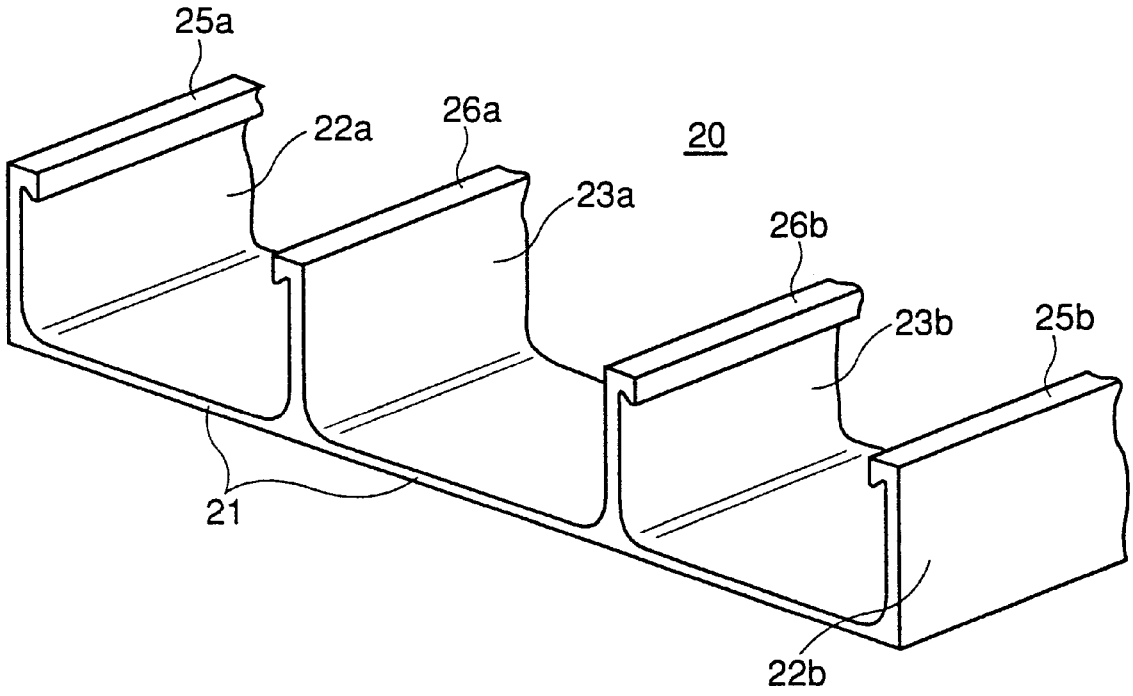
FIG. 1A is a partially fragmented perspective view showing a part close to a longitudinal end of a form member body 20 of a concrete form member according to an embodiment 1 of the present invention.
Figure 1B:
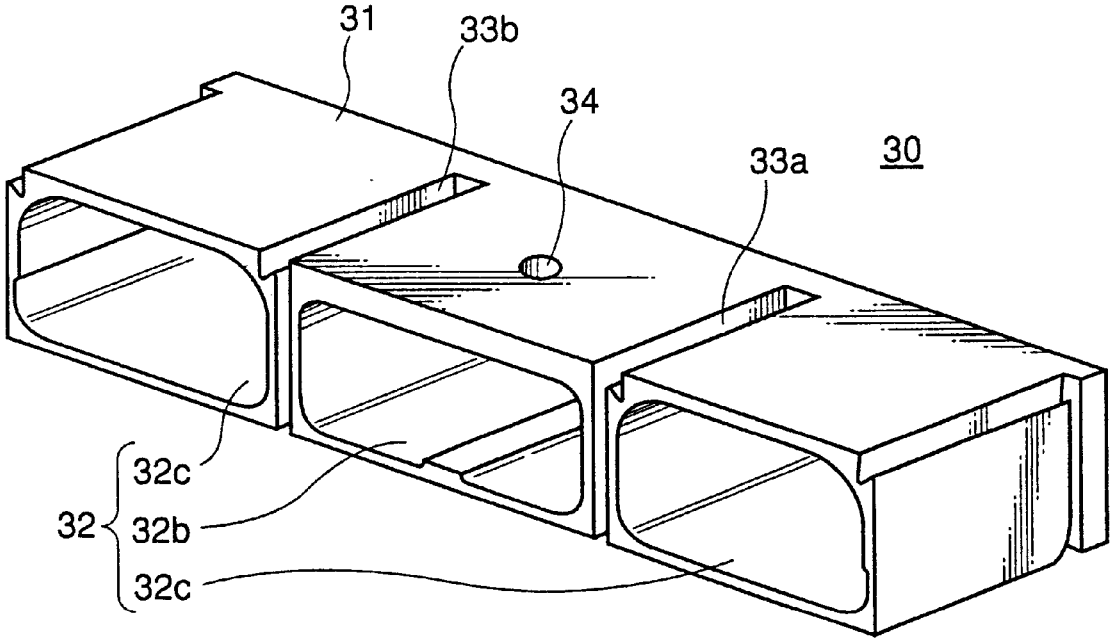
FIG. 1B is a perspective view showing an end plate body 30 for engaging with the end of the form member body 20.
Figure 2:
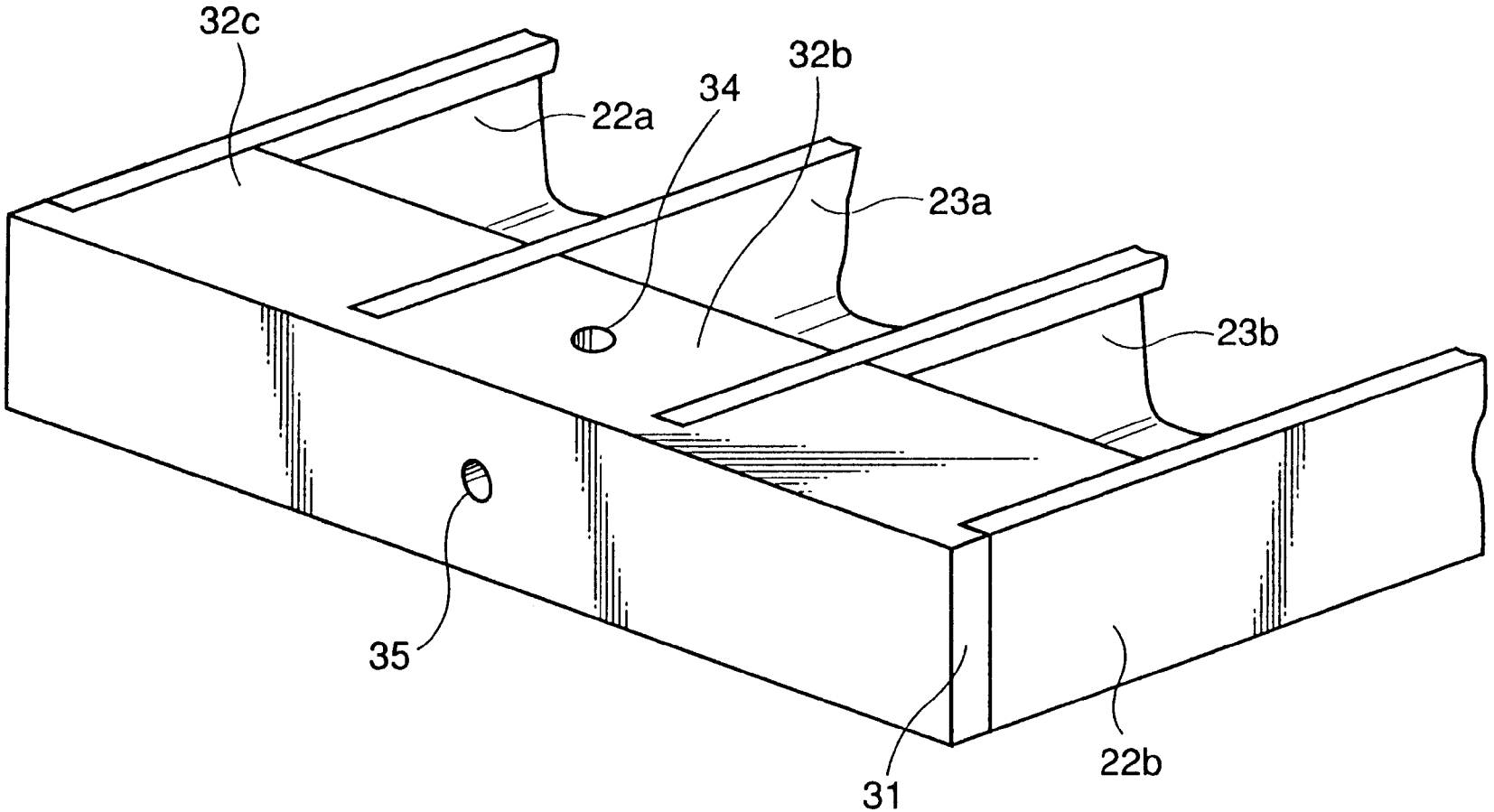
FIG. 2 is a partially fragmented perspective view showing the end plate body 30 shown in FIG. 1B in a state engaging with the end of the form member body 20) shown in FIG. 1A.

FIG. 1A is a perspective view showing a part close to an end of a form member body 20 of a concrete form member according to an embodiment 1 of the present invention, FIG. 1B is a perspective view of an end plate body 30 for engaging with the end of the form member body 20, and FIG. 2 is a perspective view showing the end plate body 30 in a state engaging with the form member body 20. As shown in FIG. 1A, the form member body 20 according to this embodiment includes a flat strip-shaped main plate portion 21 and a horizontal pair of strip-shaped side plate portions 22*a* and 22*b* extending from both sides of the main plate portion 21 toward its rear surface (upper surface in FIG. 1A) perpendicularly to the main plate portion 21. Reinforcing plates 23*a* and 23*b* are provided between the horizontal pair of side plate portions 22*a* and 22*b* to extend from the rear surface of the main plate portion 21 substantially in parallel with the side plate portions 22*a* and 22*b*.

Figure 3A:
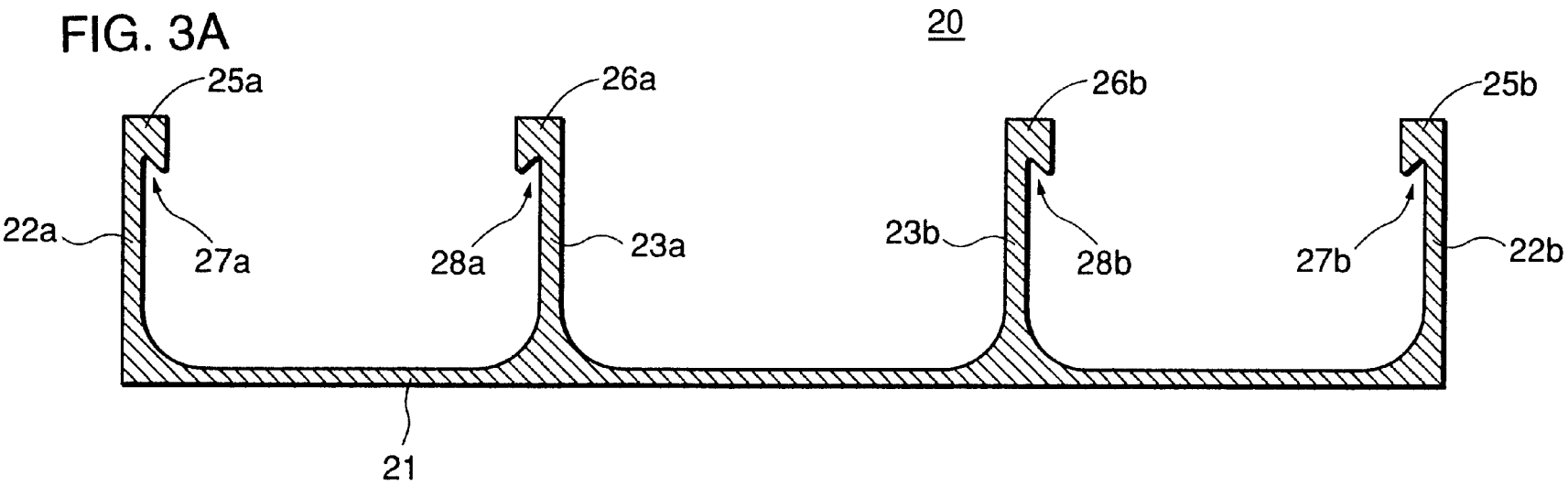
FIG. 3A is a cross-sectional view of the form member body 20 shown in FIG. 1A, and FIGS. 3B and 3C are partially fragmented sectional views showing a part close to an opening end of a side plate portion or a reinforced plate of the form member body 20 shown in FIG. 3A in an enlarged manner.
Figure 3C:
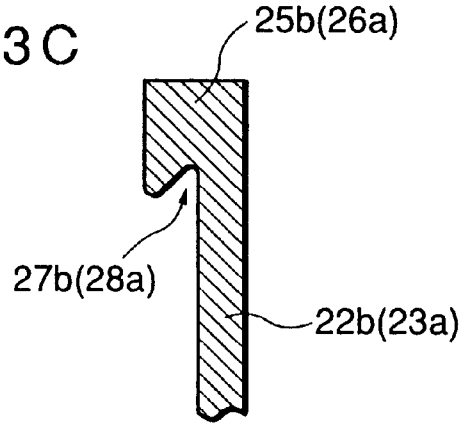
Figure 3B:
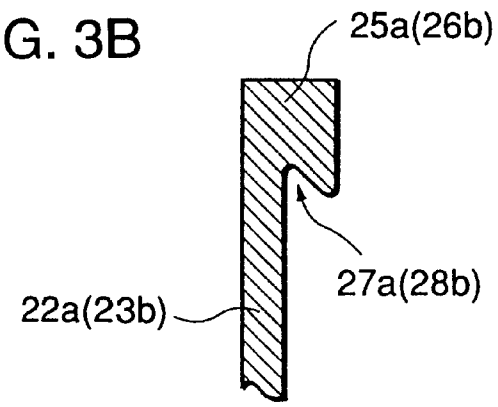
Figure 4A:
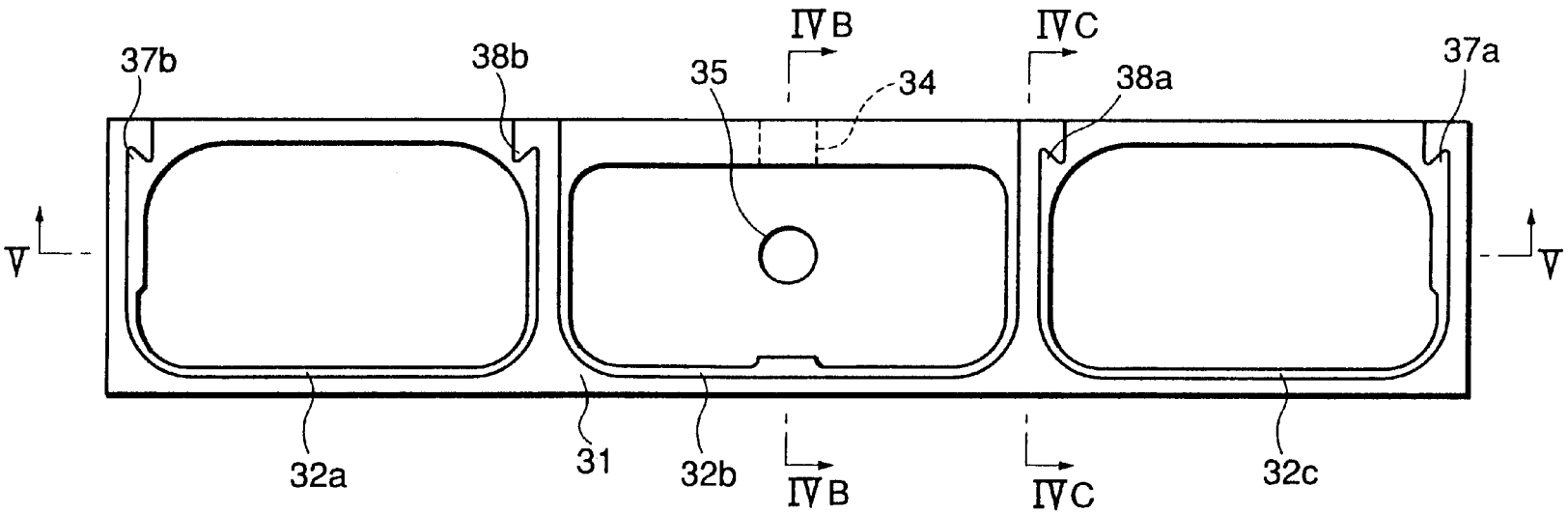
FIG. 4A illustrates the end plate body 30 shown in FIG. 1B as viewed from an opening end of an engaging portion 32.
Figure 4C:
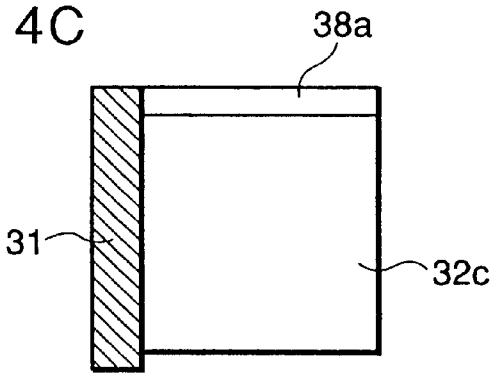
FIG. 4C is a sectional view taken along,he line IVC—IVC in FIG. 4A.
Figure 4B:
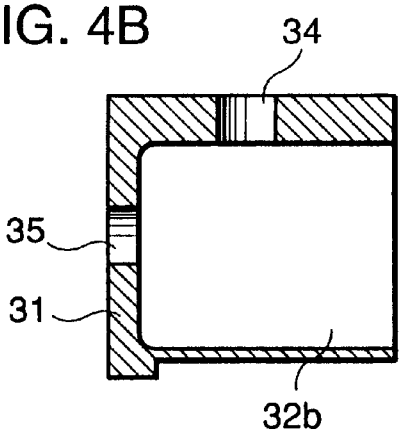
FIG. 4B is a sectional view taken along the line IVB—IVB in FIG. 4A.
Figure 5:
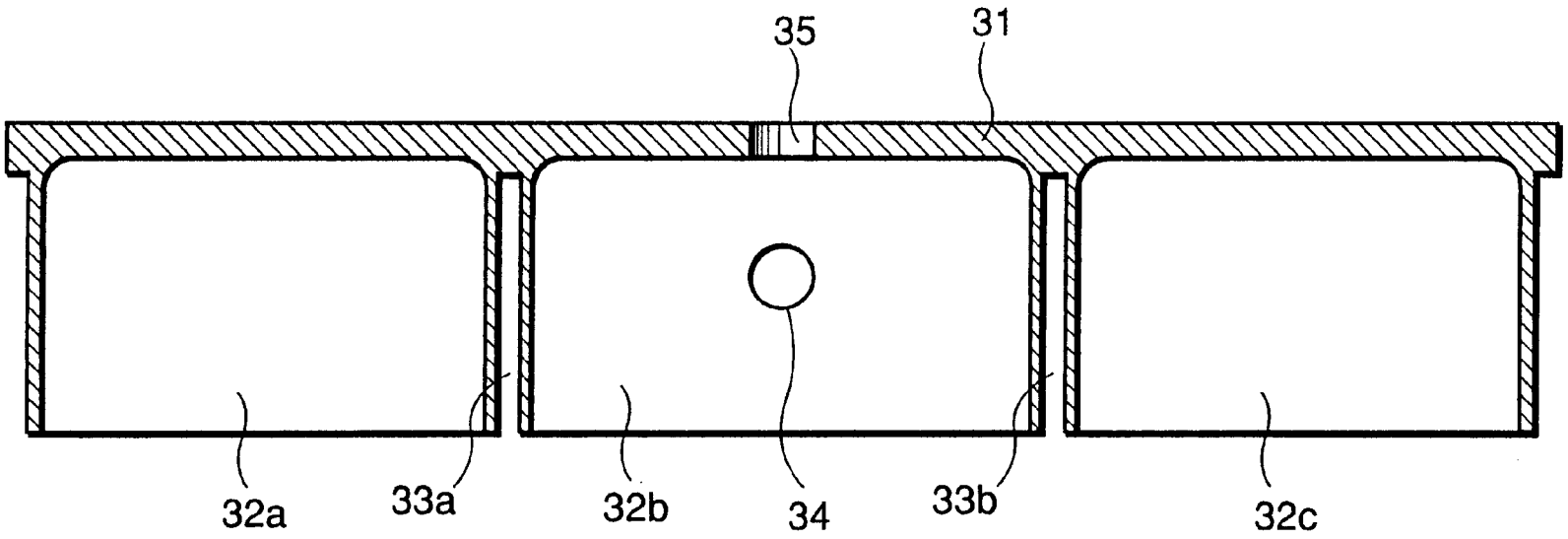
FIG. 5 is a sectional view taken along the line V—V in FIG. 4A.
Figure 6A:
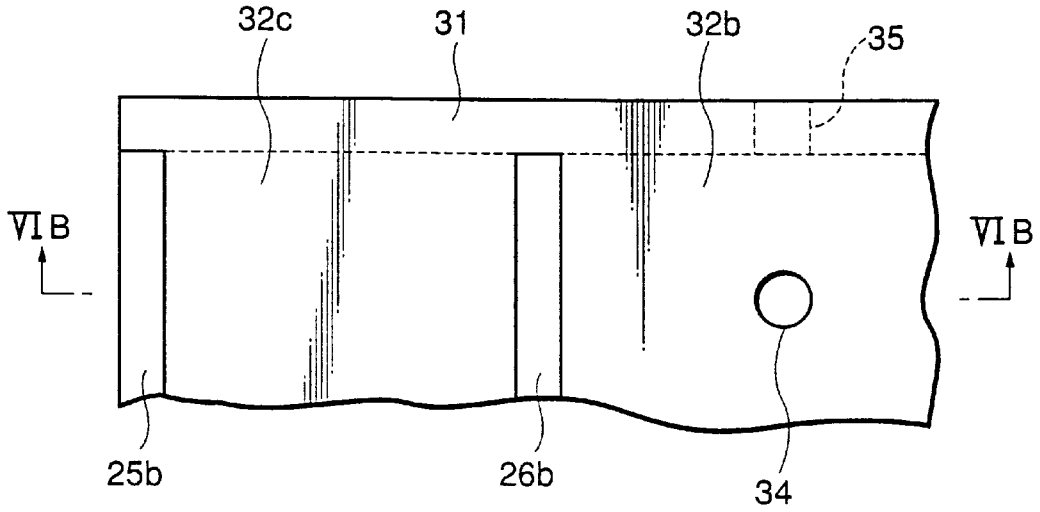
FIG. 6A is a partially fragmented plan view showing the end plate body 30 in the state engaging with the end of the form member biy 20 according to the embodiment 1 of the present invention.
Figure 6B:
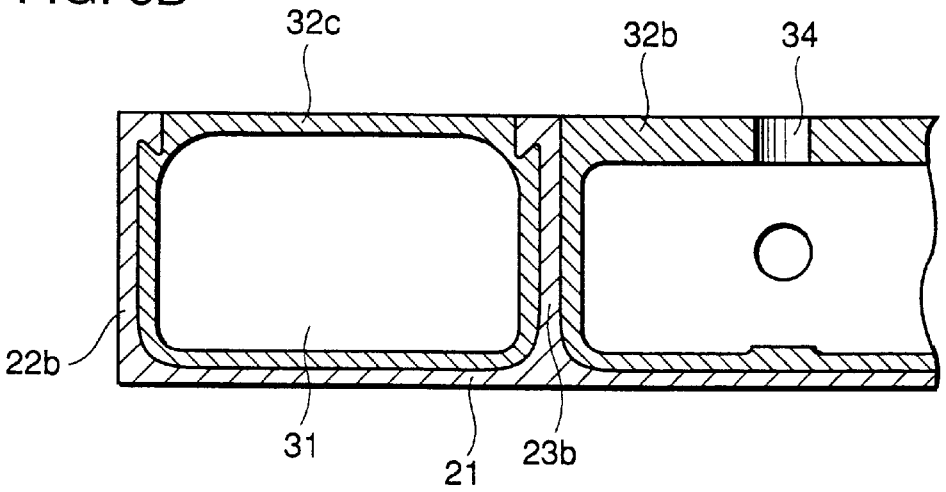
FIG. 6B is a sectional view taken along the line VIB—VIB in FIG. 6A.
Figure 6C:
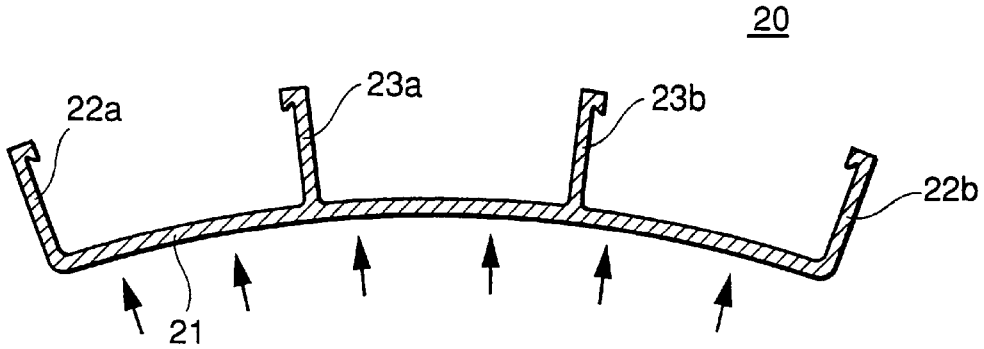
FIG. 6C is a sectional view of the form member body 20, corresponding to FIG. 3A, for illustrating a mode of deformation of the form member body 20 caused by concrete pressure in a state not engaging with the end plate body 30.

The pair of side plate portions 22*a* and 22*b* have side plate enlarged end portions 25*a* and 25*b* inwardly enlarged in thickness over prescribed widths from opening ends (upper ends in FIG. 1A) thereof respectively. The reinforcing plates 23*a* and 23*b* have reinforcing plate enlarged end portions 26*a* and 26*b* each extending toward at least one of the side plate portions 22*a* and 22*b*, over prescribed widths from opening ends thereof. As shown in FIGS. 3A and 3B, the side plate enlarged end portions 25*a* and 25*b* are provided on lower end surfaces thereof with grooves 27*a* and 27*b* concaved toward the opening ends of the side plate portions 22*a* and 22*b* and extending along the longitudinal direction of the main plate portion 21. The reinforcing plate enlarged end portions 26*a* and 26*b* are also provided on lower end surfaces with grooves 28*a* and 28*b* similar to the grooves 27*a* and 27*b*.

The form member body 20 of such a shape, having a uniform cross section, can be integrally formed by fiber-reinforced plastic through continuous draw molding. The reinforcing fiber, preferably prepared from glass fiber, may be prepared from carbon fiber or aramides (trade name) fiber. The plastic component, preferably prepared from polyester thermosetting resin, may be prepared from thermoplastic resin.

In the form member body 20 according to this embodiment having the aforementioned shape, the reinforcing plates 23*a* and 23*b* exhibit a reinforcing effect as ribs. Consequently, the form member body 20 is remarkably inhibited from bending deformation resulting from pressure exerted by the concrete placing in a plane parallel to the central longitudinal section thereof. Accordingly, the form member body 20 can be reduced in thickness and weight.

The end plate body 30 according to this embodiment includes a shielding plate portion 31 and an engaging portion 32 as shown in FIGS. 1B, 4A, 4B, 4C and 5. The shielding plate portion 31 has a shape for shielding a longitudinal end of a space, having a rectangular cross. The space is enclosed with the main plate portion 21 and the pair of side plate portions 22*a* and 22*b*. The engaging portion 32 is formed by three tubular bodies 32*a*, 32*b* and 32*c* engaging with three spaces, having rectangular cross sections, partitioned by the reinforcing plates 23*a* and 23*b* respectively. Slot-shaped clearances 33*a* and 33*b* are provided between the adjacent tubular bodies 32*a*, 32*b* and 32*c* so that the reinforcing plates 23*a* and 23*b* of the form member body 20 tightly engage with the clearances 33*a* and 33*b* in the engaging state shown in FIG. 2.

Figure 11A:
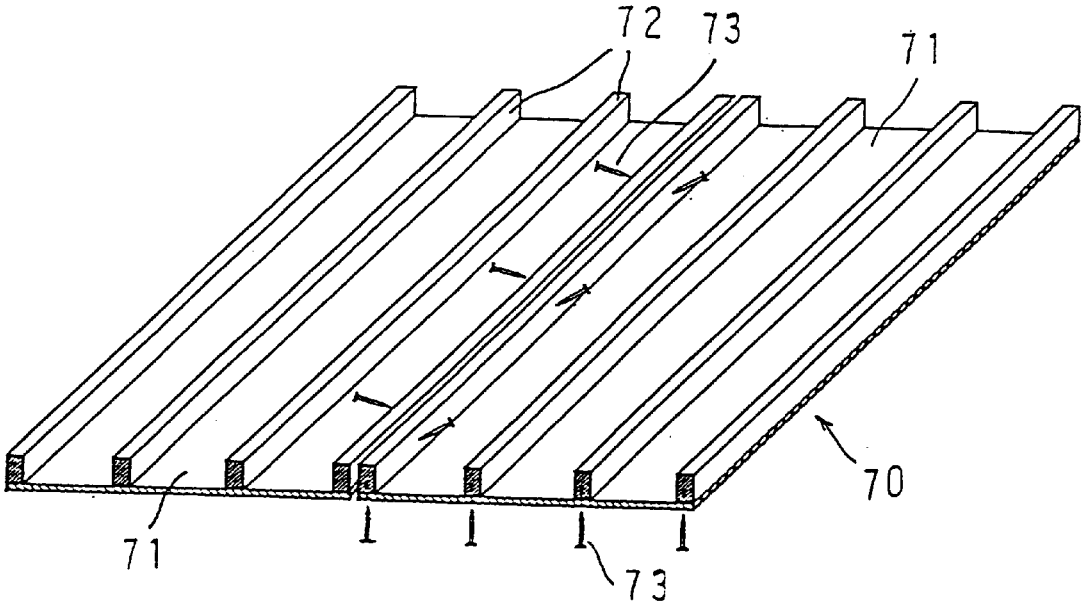
FIG. 11A PRIOR ART
FIG. 11A is a perspective view showing a typical example of a conventional wooden form member.
Figure 11B:
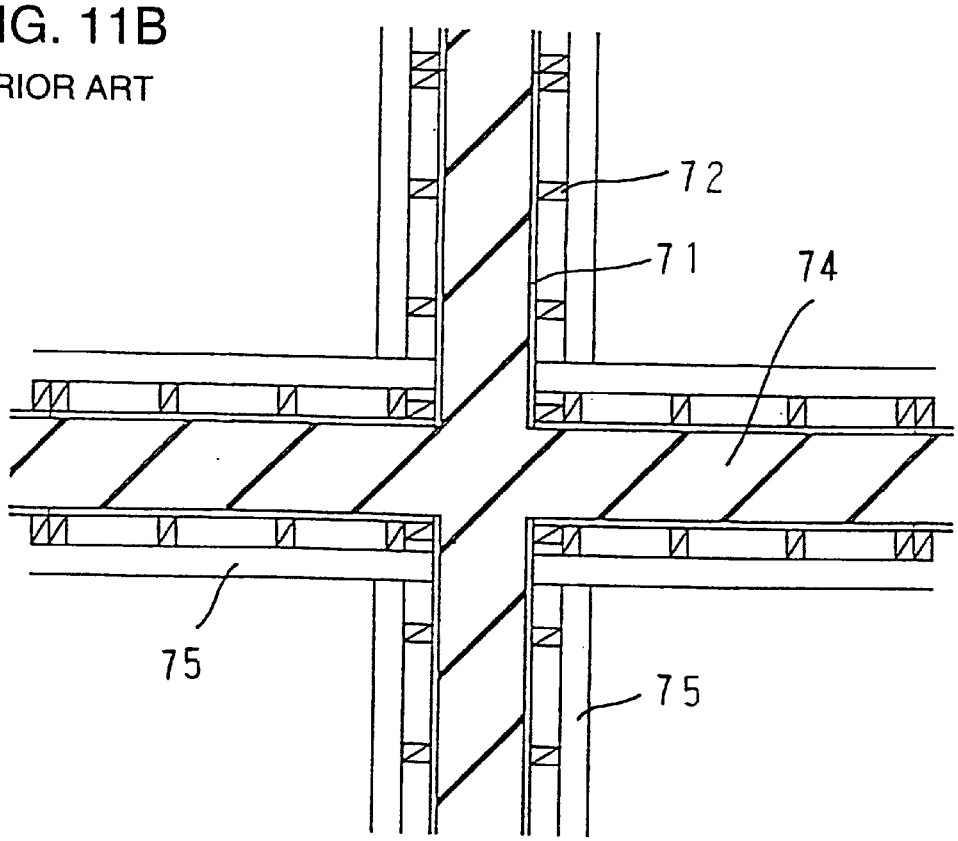
FIG. 11B PRIOR ART
FIG. 11B is a plan view of a form having a cross-shaped concrete forming part formed by the form member shown in FIG. 11A.
Figure 12:
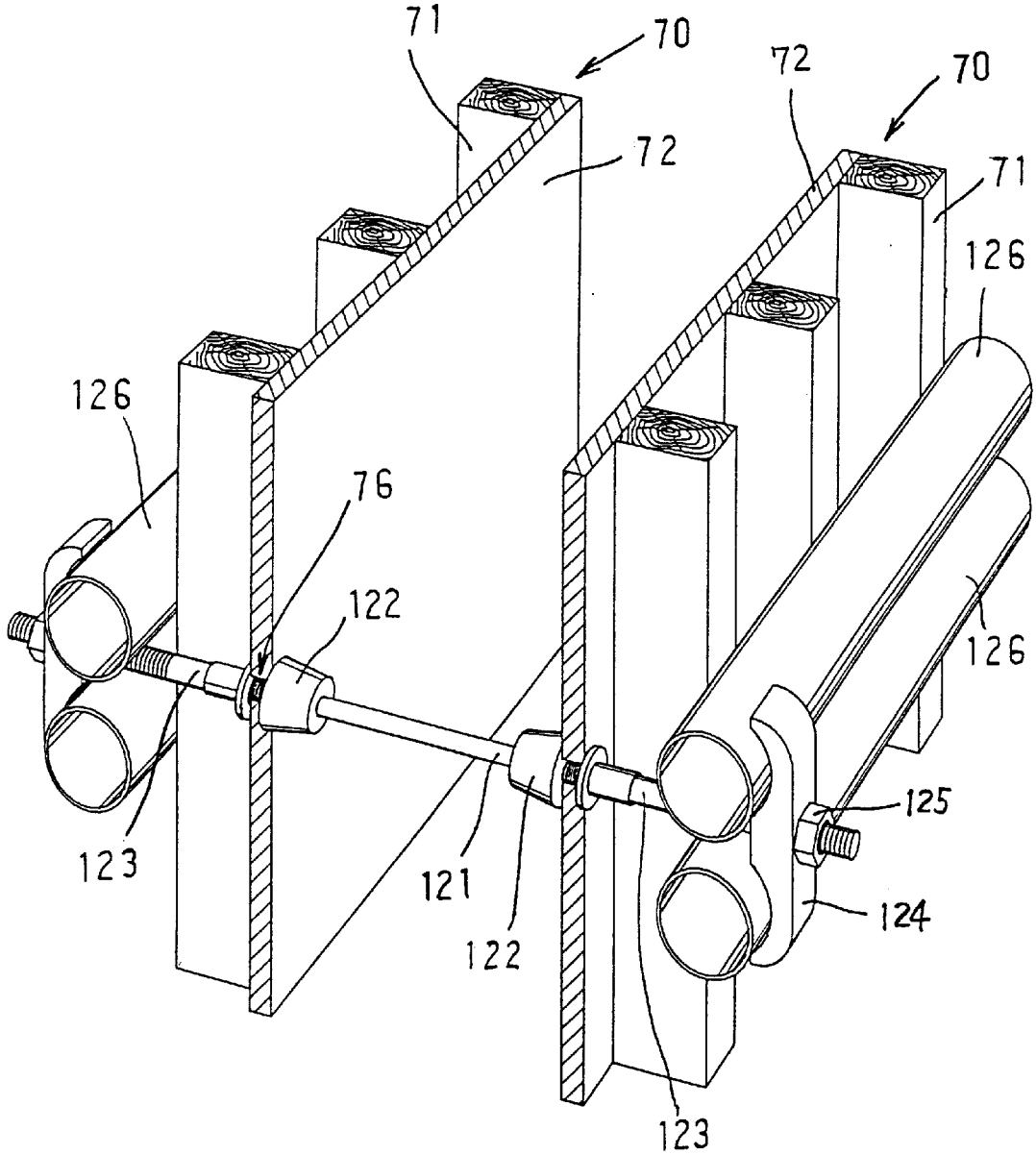
FIG. 12 PRIOR ART
FIG. 12 is a partially fragmented perspective view showing a pair of conventional wooden form members connected/fixed to each other with a conventional form member space holder.
Figure 13A:
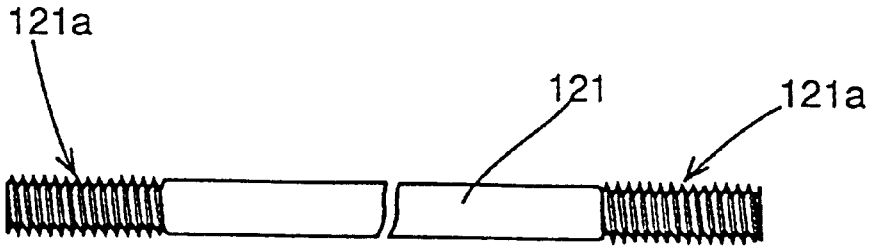
FIG. 13A PRIOR ART
FIGS. 13A, 13B and 13C illustrate each part of a conventional form member space holder employed for connecting/fixing the wooden form members shown in FIG. 12 to each other, with FIG. 13A showing a separator 121 in a partially omitted manner, FIG. 13B a partially fragmented sectional view showing an attachment 122, and FIG. 13C a partially fragmented sectional view showing a clamp member 123.
Figure 13B:
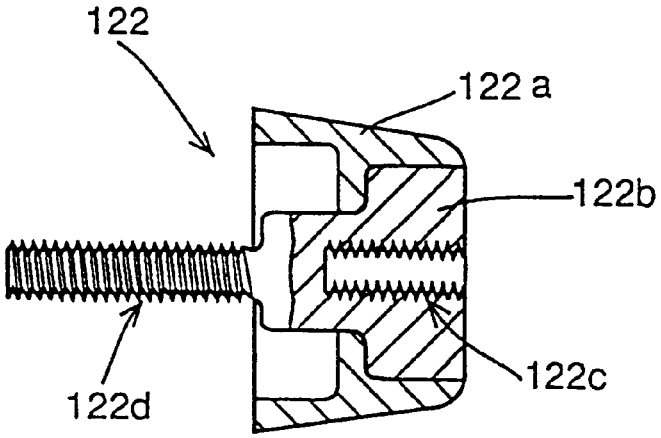
FIG. 13B PRIOR ART
Figure 13C:
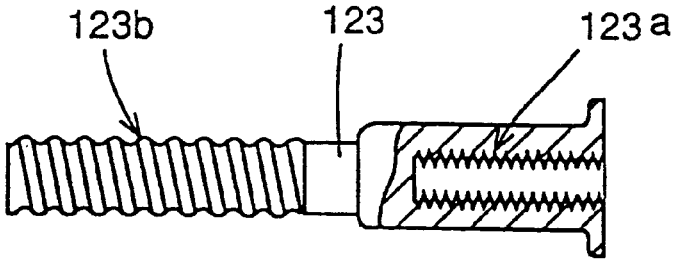
FIG. 13C PRIOR ART
Figure 14A:
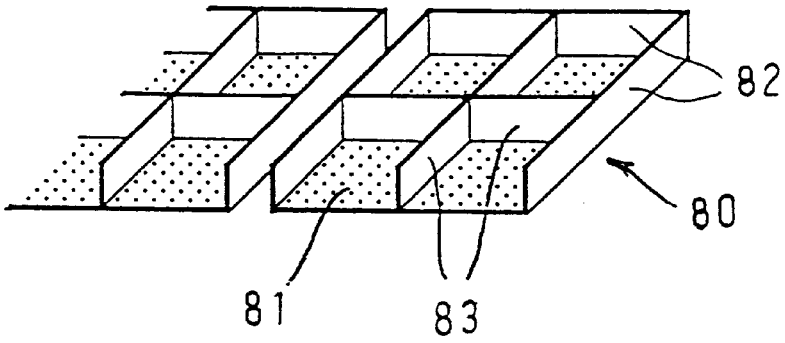
FIG. 14A PRIOR ART
FIG. 14A is a perspective view showing a typical example of a conventional metal form member.
Figure 14B:
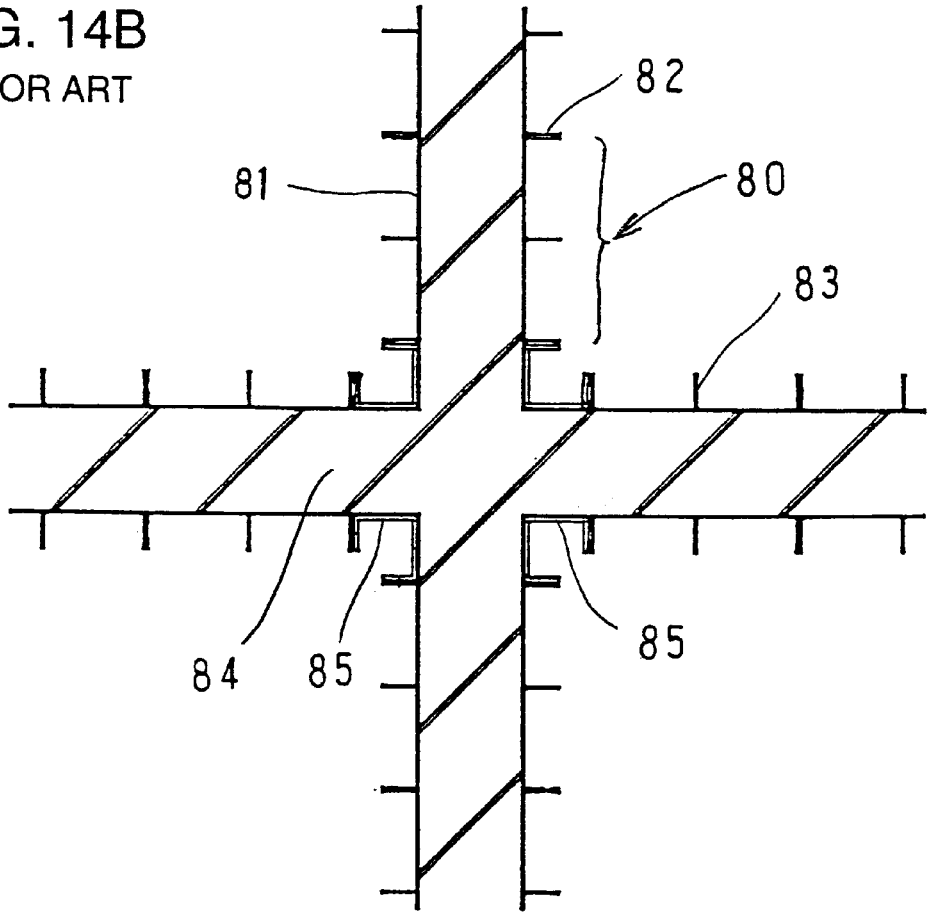
FIG. 14B PRIOR ART
FIG. 14B is a plan view of a form having a cross-shaped concrete forming part formed by the metal form member shown in FIG. 14A.
Figure 15:
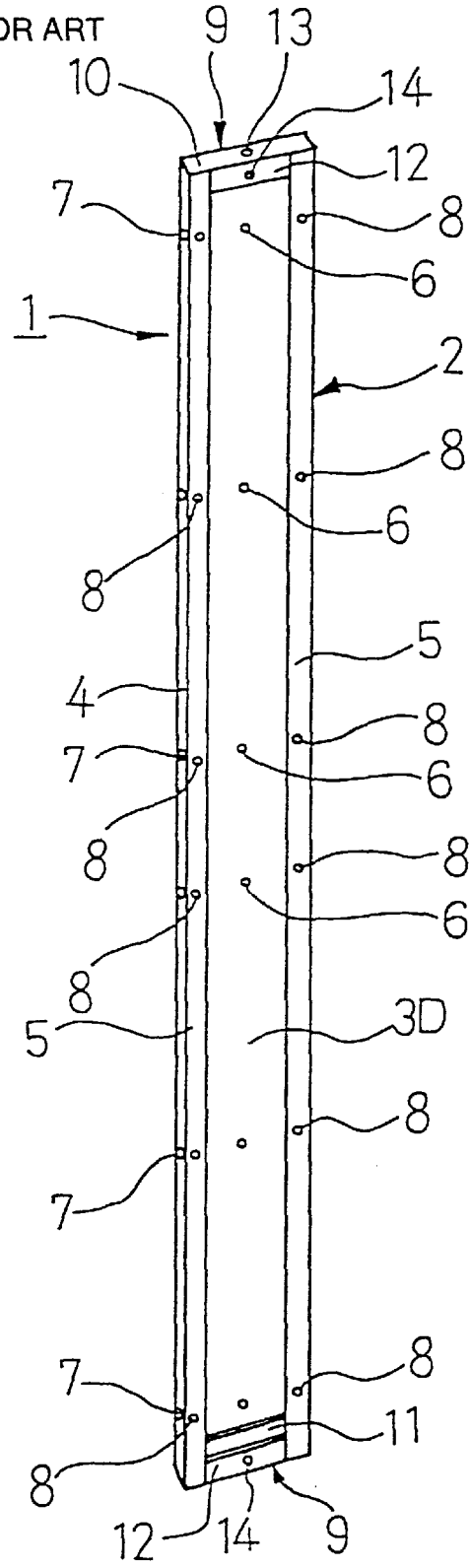
FIG. 15 PRIOR ART
FIG. 15 is a perspective view showing an improved conventional concrete form member proposed by the inventor in U.S. Pat. No. 5,632,923.
Figure 16:
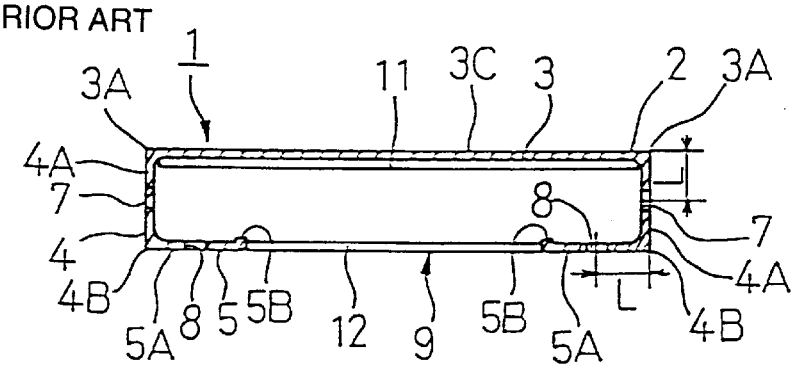
FIG. 16 PRIOR ART
FIG. 16 is a cross-sectional view showing a position of the conventional concrete form member shown in FIG. 15 provided with a mounting hole.
Figure 17:
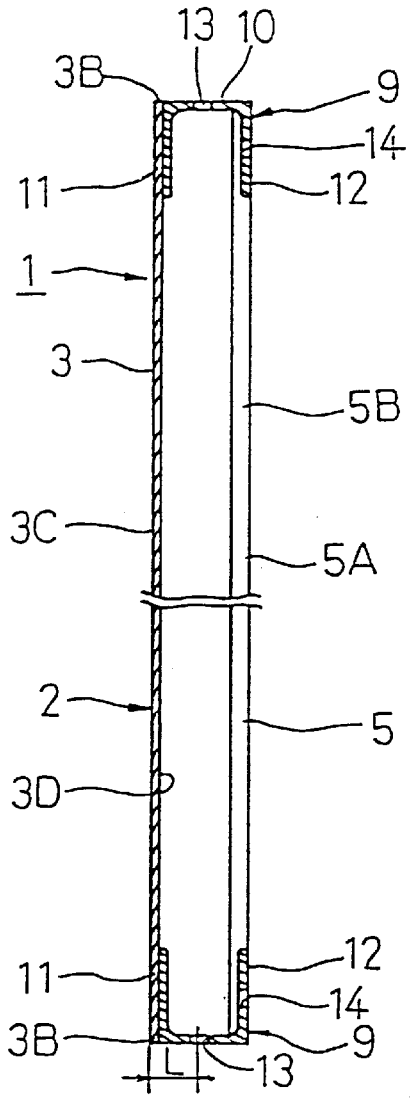
FIG. 17 PRIOR ART
FIG. 17 is a central longitudinal sectional view of the conventional concrete form member shown in FIG. 15.
Figure 18:
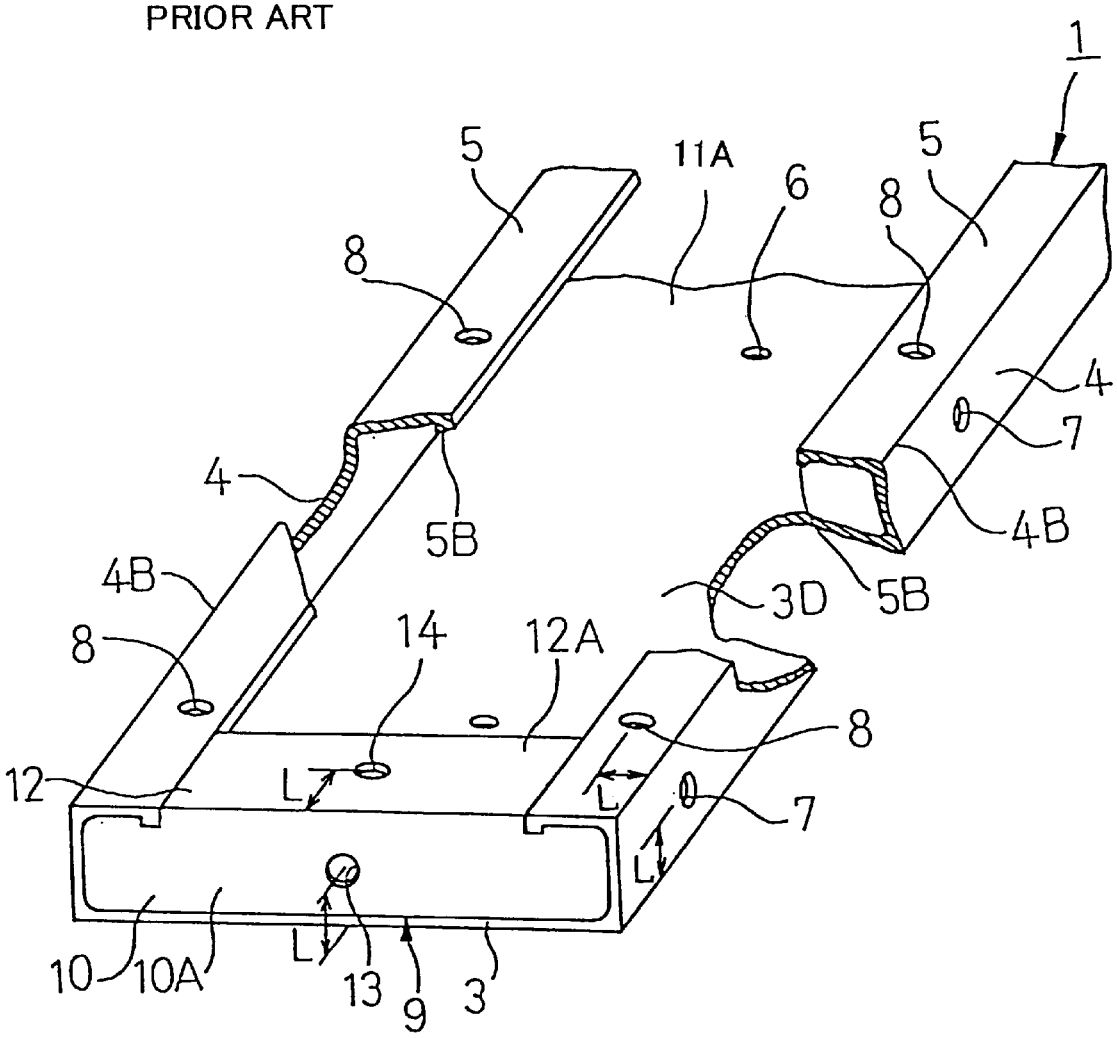
FIG. 18 PRIOR ART
FIG. 18 is a partially enlarged perspective view showing a part close to an end of the conventional concrete form member shown in FIG. 15 in a partially fragmented manner.

Mounting holes 34 and 35 are provided on the central portion of the upper surface of the central tubular body 32*b* of the end plate body 31 and the central portion of the shielding plate portion 31 respectively, in order to receive clamp members for joining the form member with another form member or an end plate body engaging therewith. These mounting holes 34 and 35 are employed for assembling the concrete form having the cross-shaped concrete forming part 74 shown in FIG. 11, for example. The end plate body 30 having such a shape can also be prepared by integral forming of fiber-reinforced plastic, similarly to the form member body 20.

The tubular bodies 32*a* and 32*c* forming the engaging portion 32 of the end plate body 30 are provided on upper end portions thereof with longitudinal projections 37*a*, 37*b*, 38*a* and 38*b* to tightly engage with the grooves 27*a*, 27*b*, 28*a* and 28*b* in the state engaging with the form member body 20. Thus, the grooves 27*a*, 27*b*, 28*a* and 28*b* and the longitudinal projections 37*a*, 37*b*, 38*a* and 38*b* tightly engage with each other in the engaging state of the form member body 20 and the end plate body 30, thereby inhibiting the side plate portions 22*a* and 22*b* of the form member body 20 from deformation in opening directions. Consequently, the form member body 20 is inhibited from bending deformation (shown in FIG. 6C) caused by pressure resulting from concrete placed in the assembled form. Thus, the surface of a concrete is flatly formed without the need to bring another reinforcing member into contact with the form member body 20 when assembling the concrete form.

Figure 7:
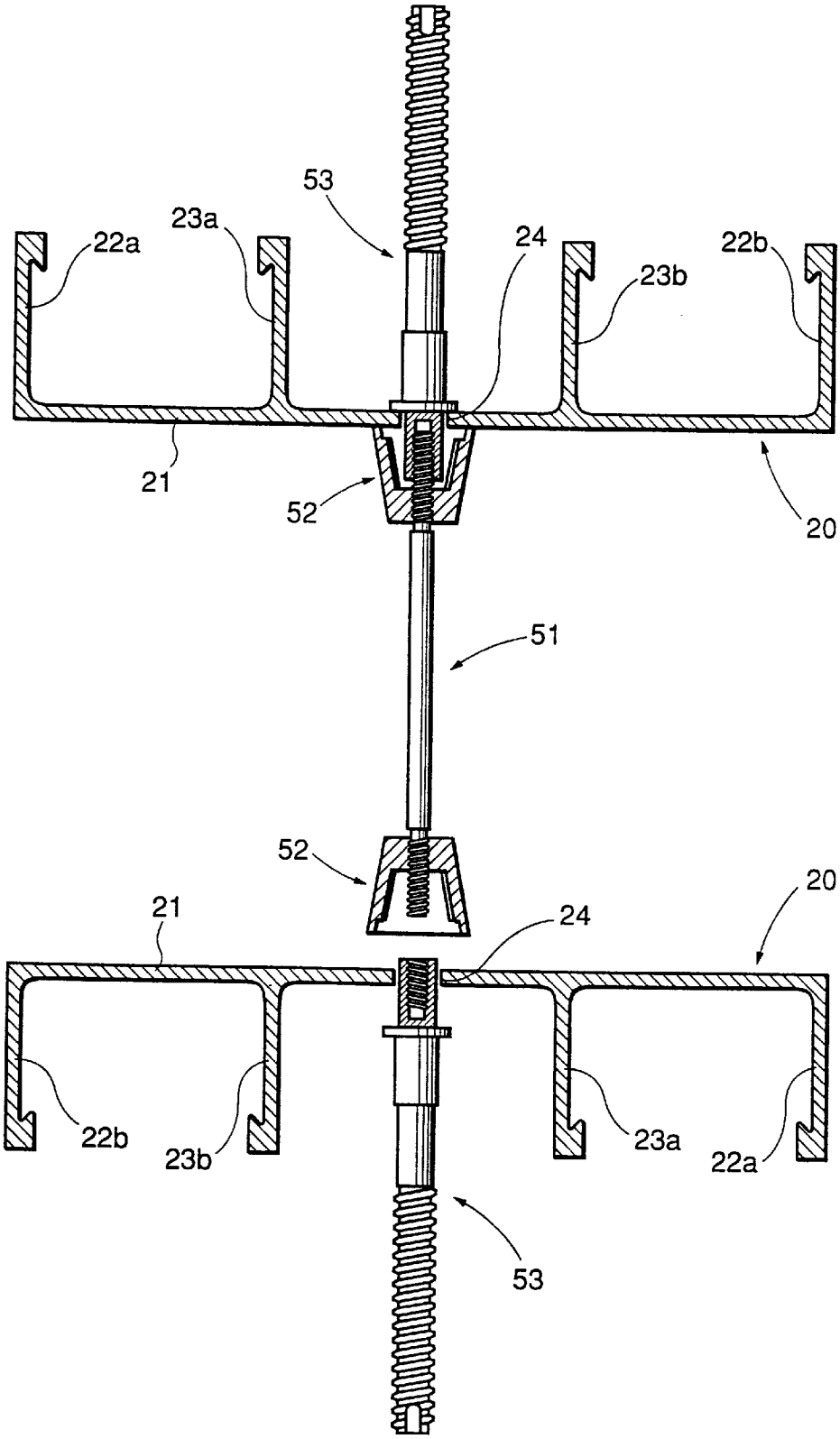
FIG. 7 is a diagram for illustrating a state of assembling a concrete form by opposing two form member bodies 20 according to the embodiment 1 of the present invention with a form opposite space holder disclosed in U.S. Pat. No. 5,761,874.

As shown in FIG. 7, a concrete form can be assembled by oppositely arranging a pair of form member bodies 20 according to this embodiment and clamping the same with a form opposite space holder already proposed by the inventor in U.S. Pat. No. 5,761,874. Referring to FIG. 7, the form opposite space holder is formed by a separator 51, attachments 52 and clamp members 53. In order to relatively hold/fix the pair of form member bodies 20 with this form opposite space holder, first ends of the clamp members 53 are inserted in the mounting holes 24 provided on the centers of the main plate portions 21 of the form member bodies 20 and female screws of the attachments 52 are fitted with male screws provided on both ends of the separator 51 while ends of the male screws provided on the ends of the separator 51 are fitted with female screws provided on second ends of the clamp members 53. Thus, the clamp members 53 clamp the separator 51 and the attachments 52 to the form member bodies 20.

Figure 8A:
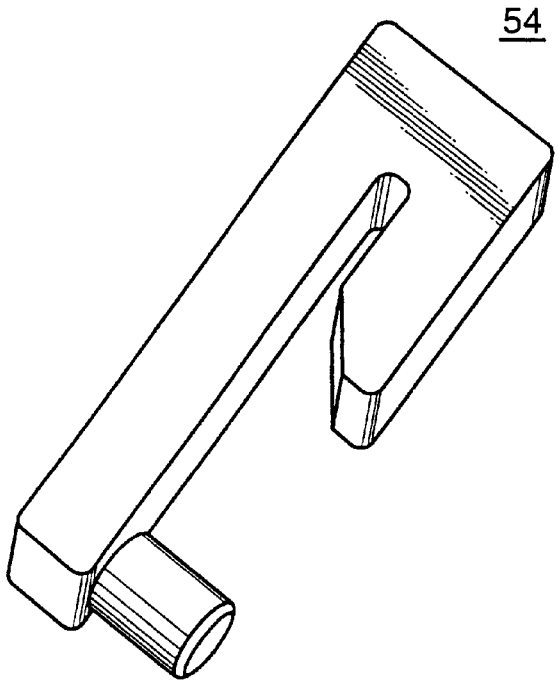
FIG. 8A PRIOR ART
FIG. 8A is a perspective view of a form member connector disclosed in European Patent Laying-Open No. EP0738808A1.
Figure 8B:
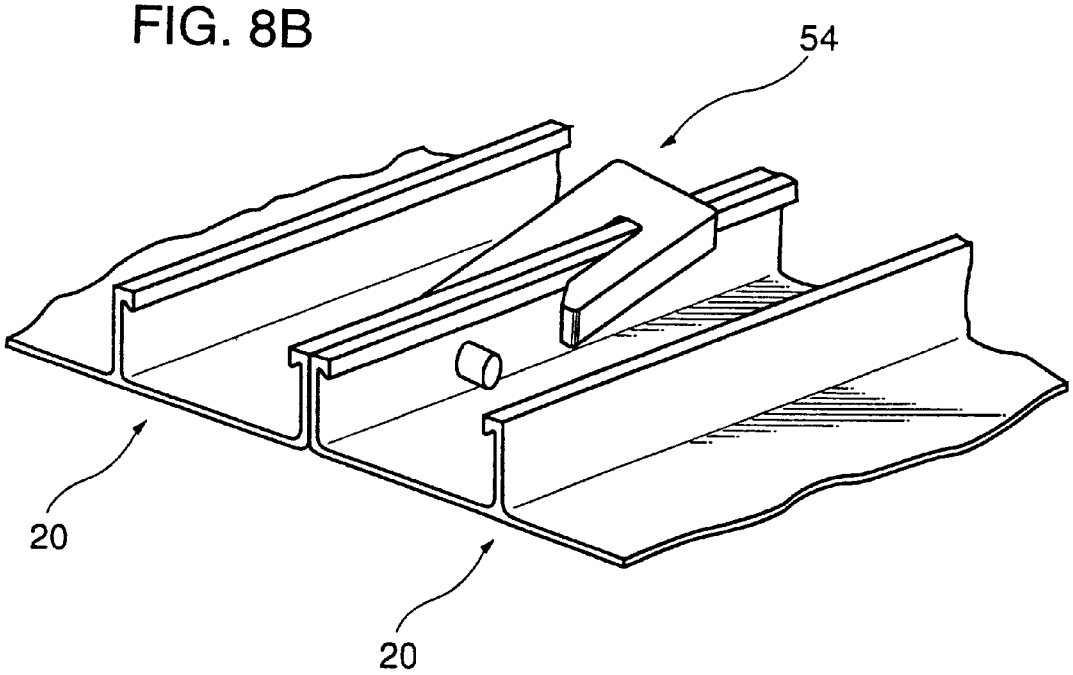
FIG. 8B is a partially fragmented perspective view showing the form member connector connecting two transversely arranged form member bodies according to the embodiment 1 of the present invention.

For the concrete form member according to this embodiment, a form member connector shown in FIG. 8A, already proposed by the inventor in European Patent Laying-Open No. EP0738808A1, can be employed for readily connecting/fixing two form member bodies 20 transversely arranged as shown in FIG. 8B, in order to temporarily fix these form member bodies 20 for assembling a form.

(Embodiment 2)

Figure 9A:
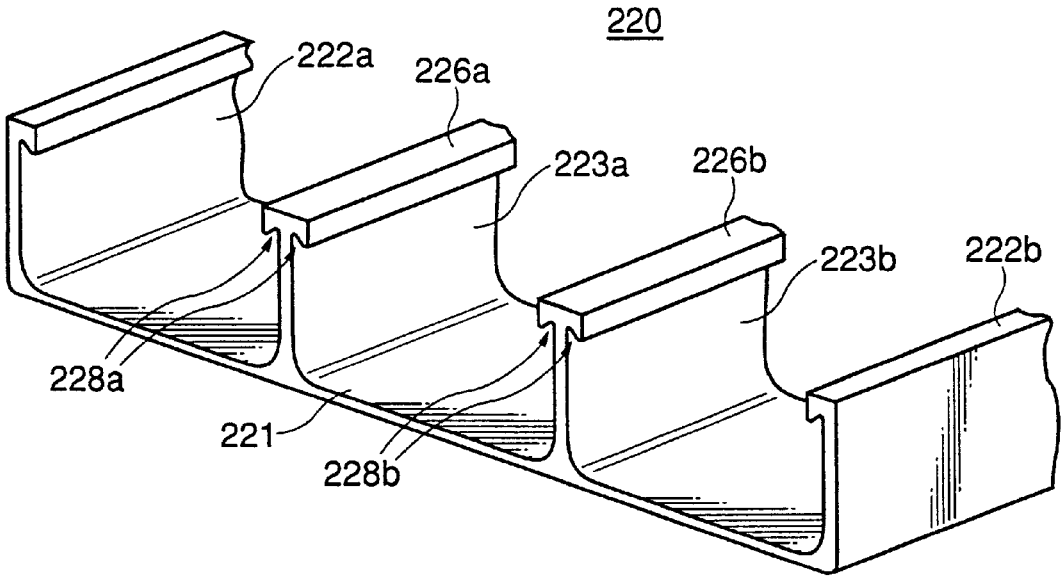
FIG. 9A is a partially fragmented perspective view showing a part close to a longitudinal end of a form member body 220 of a concrete form member according to an embodiment 2 of the present invention.
Figure 9B:
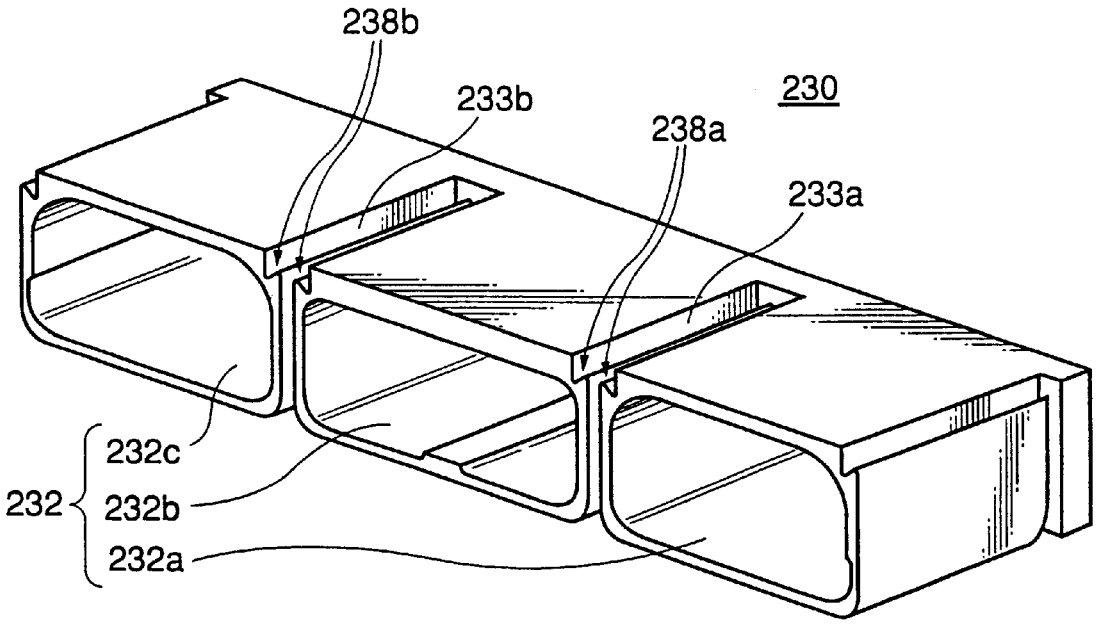
FIG. 9B is a perspective view showing an end plate body 230 for engaging with the end of the form member body 220.

A concrete form member according to an embodiment 2 of the present invention is now described with reference to FIGS. 9A and 9B. As understood from FIG. 9A, a form member body 220 of the concrete form member according to this embodiment includes a main plate portion 221 and a pair of side plate portions 222*a* and 222*b* having shapes identical to those of the main plate portion 21 and the pair of side plate portions 22*a* and 22*b* of the form member body 20 according to the embodiment 1, while reinforcing plate enlarged end portions 226*a* and 226*b* provided on opening ends of reinforcing plates 223*a* and 223*b* are different in shape from those in the embodiment 1. More specifically, while the grooves 28*a* and 28*b* are provided on the reinforcing plate enlarged end portions 26*a* and 26*b* of the reinforcing plates 23*a* and 23*b* only on sides opposite to the closer side plate portions 22*a* and 22*b* in the form member body 20 according to the embodiment 1, the reinforcing plate enlarged end portions 226*a* and 226*b* of the reinforcing plates 223*a* and 223*b* of the form member body 220 according to this embodiment are provided with pairs of grooves 228*a* and 228*b* corresponding to the grooves 28*a* and 28*b* in a horizontally symmetrical manner.

In correspondence to the aforementioned shape of the form member body 220, an end plate body 230 according to this embodiment is provided with pairs of longitudinal projections 238*a* and 238*b* on upper ends of clearances 233*a* and 233*b* between adjacent tubular bodies 232*a,* 232*b* and 232*c* forming an engaging portion 232 in a horizontally symmetrical manner, to tightly engage with an end of the form member body 220.

According to this embodiment, the pairs of grooves 228*a* and 228*b* are provided on the reinforcing enlarged end portions 226*a* and 226*b* of the reinforcing plates 223*a* and 223*b* of the form member body frame 220 in a horizontally symmetrical manner, thereby improving the reinforcing effect of the reinforcing plates 223*a* and 223*b* serving as ribs. Thus, an effect of inhibiting the form member body 220 from bending deformation in a plane parallel to the central longitudinal section thereof is further improved.

When the end plate portion 230 engages with an end of the form member body 220, the side plate portions 222*a* and 222*b* and the reinforcing plates 223*a* and 223*b* are further effectively prevented from deformation, to further remarkably improve the effect of inhibiting the form member body 220 from bending deformation in the plane parallel to the cross section thereof.

Figure 10A:
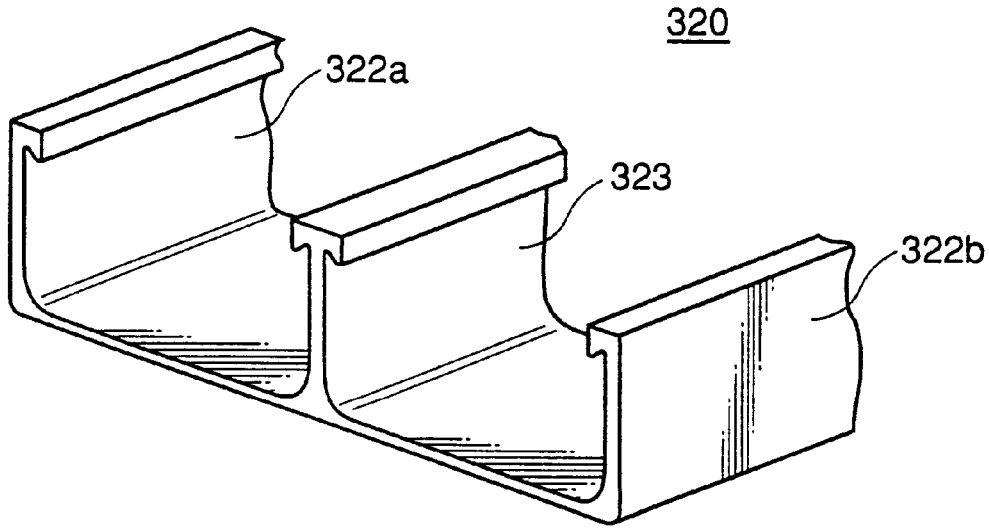
FIG. 10A is a partially fragmented perspective view showing a part close to a longitudinal end of a form member body 320 in a modification of the concrete form member according to the embodiment 2 of the present invention.
Figure 10B:
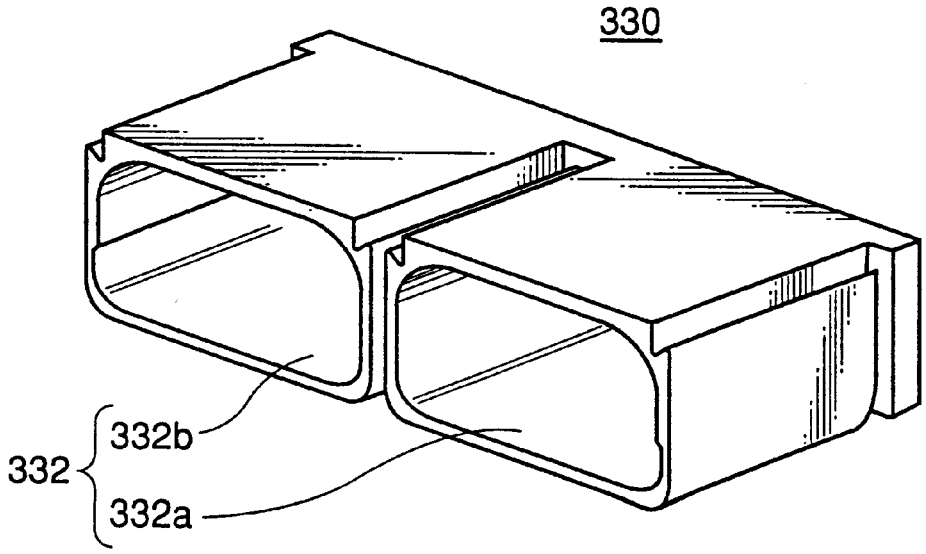
FIG. 10B is a perspective view showing an end plate body 330 for engaging with the end of the form member body 320.

While two reinforcing plates 223*a* and 223*b* are provided between the pair of side plates 222*a* and 222*b* in the form member body 220 according to this embodiment, only a single reinforcing plate 323 may be provided substantially centrally between a pair of side plate portions 322*a* and 322*b* in a form member body 320 according to a modification of this embodiment, as shown in FIG. 10A. In this case, an engaging portion 332 of an end plate body 330 is formed by two tubular bodies 332*a* and 332*b* to tightly engage with an end of the form member body 320, as shown in FIG. 10B.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A concrete form member comprising:

a strip-shaped main plate portion having two sides, a rear surface, and at least a front surface that is flat;

a horizontal strip-shaped side plate portion extending from each of the two sides of said main plate portion perpendicularly to said main plate portions; and a reinforcing plate provided to extend film said rear surface of said main plate portion substantially in parallel with said horizontal pair of side plate portions, wherein each of said pair of side plate portions includes a side plate enlarged end portion over a prescribed width along a free end thereof, and said reinforcing plate includes a reinforcing plate enlarged end portion enlarged in thickness toward at least on of said side plate portions over a prescribed width along a free end thereof, wherein said side plate enlarged end portion and said reinforcing plate enlarged end portion each includes a groove extending along the longitudinal direction of said main plate portion.

2. The concrete form member in accordance with claim 1, wherein said reinforcing plate enlarged end portion has a shape enlarged in thickness toward both of said pair of side plate portions.

3. The concrete form member in accordance with claim 1, wherein said main plate portion, said pair of side plate portions and said reinforcing plate are made of integrally formed fiber-reinforced plastic.

4. The concrete form member in accordance with claim 1, wherein said main plate portion, said pair of side plate portions and said reinforcing plate form a form member body, said concrete form member further comprising an end plate body including:

a shielding plate portion arranged on at least one of both longitudinal ends of said form member body for defining an enclosure in conjunction with said main plate portion and said pair of side plate portion said shielding plate portion having a rectangular cross section, and an engaging portion extending from said shielding plate portion by a prescribed length substantially perpendicularly to said shielding plate portion and provided to engage with an end of said form member body by coming into contact with said rear surface of said main plate portion, inner side surfaces of said pair of side plate portions and a surface of said reinforcing plate.

5. The concrete form member in accordance with claim 4, further including a longitudinal projection extending from said engaging portion to engage said groove on each of said side plate enlarged end portion and said reinforcing plate enlarged end portion in a part of said engaging portion of said end plate body.

6. The concrete form member in accordance with claim 4, wherein said engaging portion of said end plate body includes a plurality of tubular bodies having outer peripheral surfaces coming into contact with said rear surface of said main plate portion, said inner side surfaces of said pair of side plate portions and said surface of said reinforcing plate.

7. The concrete form member in accordance with claim 4, wherein said end plate body is made of integrally formed fiber-reinforced plastic.

* * * * *